US010492617B1

(12) United States Patent
Macedo

(10) Patent No.: US 10,492,617 B1
(45) Date of Patent: Dec. 3, 2019

(54) SUPPORT APPARATUS FOR SUPPORTING A PERSON'S HEAD ABOVE A MATTRESS OR OTHER SURFACE

(71) Applicant: David A. Macedo, Hanford, CA (US)

(72) Inventor: David A. Macedo, Hanford, CA (US)

( * ) Notice: Subject to any disclaimer, the term of this patent is extended or adjusted under 35 U.S.C. 154(b) by 0 days.

(21) Appl. No.: 15/632,343

(22) Filed: Jun. 24, 2017

(51) Int. Cl.
*A47C 20/04* (2006.01)
*A47C 20/02* (2006.01)

(52) U.S. Cl.
CPC ..... *A47C 20/043* (2013.01); *A47C 20/02* (2013.01)

(58) Field of Classification Search
CPC ..... A47C 20/02; A47C 20/043; A47B 27/00; A47B 19/06; A47B 2200/0097; A47B 23/042
USPC ..... 5/640
See application file for complete search history.

(56) References Cited

U.S. PATENT DOCUMENTS 986,131 A * 3/1911 Braasch ..... A47B 27/00 108/6
1,098,236 A 5/1914 Duckworth
1,211,871 A 1/1917 Peoples
1,652,774 A * 12/1927 Fraser ..... A47B 19/06 312/233
2,661,989 A 1/1953 Weiland
2,666,216 A * 1/1954 Schnaitter ..... A47C 20/027 5/660
3,116,955 A * 1/1964 Siegal ..... A47C 1/06 297/423.35
3,387,713 A * 6/1968 Brooks ..... A47B 65/00 211/188
4,287,835 A * 9/1981 Stratton ..... A47B 23/046 108/26
4,460,145 A * 7/1984 Ando ..... A47B 46/00 108/140
4,539,977 A * 9/1985 Schneider, Sr. ..... A47C 16/02 297/423.41
4,593,684 A * 6/1986 Graham ..... A61H 1/0218 297/396
5,033,138 A * 7/1991 Hong ..... A47G 9/1009 5/636
5,098,160 A * 3/1992 Moore ..... A47C 16/025 297/174 R
5,329,658 A 7/1994 Fontenot et al.
(Continued)

FOREIGN PATENT DOCUMENTS

EP 0415420 A2 3/1991

*Primary Examiner* — Peter M. Cuomo
*Assistant Examiner* — Myles A Throop
(74) *Attorney, Agent, or Firm* — Richard A. Ryan

(57) ABSTRACT

A support apparatus that is configured to support a person's head as he or she lies in a generally prone position with the apparatus in a horizontal support position and to support his or her back as he or she sits in an inclined position with the apparatus in an inclined support position. The apparatus has a transverse support member interconnecting a pair of vertical support members to provide an upper pillow-receiving surface and to define a gap under the transverse support member for receiving the user's arms when he or she is laying down. The apparatus also has base members on the vertical support members to distribute the weight, a rear support member to prevent a pillow from sliding off of the upper pillow-receiving surface and one or more rearwardly disposed stand-off members to space the apparatus from a wall or headboard.

20 Claims, 6 Drawing Sheets

(56) References Cited

U.S. PATENT DOCUMENTS

| | | | | | |
|---|---|---|---|---|---|
| 5,337,429 | A | | 8/1994 | Tucker | |
| 5,419,618 | A | * | 5/1995 | Hatcher | A47C 16/025 297/423.45 |
| 5,622,272 | A | * | 4/1997 | Orlando, Jr. | A47B 57/04 211/150 |
| 5,855,329 | A | * | 1/1999 | Pagano | A47B 23/042 248/444.1 |
| 6,139,567 | A | * | 10/2000 | McCarty | A47C 4/52 5/633 |
| 7,041,033 | B2 | | 5/2006 | Tom | |
| 8,336,142 | B1 | * | 12/2012 | See | A61G 13/1215 5/633 |
| 9,468,319 | B2 | | 10/2016 | Wagner | |
| 2001/0010351 | A1 | * | 8/2001 | Schutze | A47B 19/06 248/441.1 |
| 2005/0187074 | A1 | * | 8/2005 | Barr | A47C 16/025 482/79 |

* cited by examiner

SUPPORT APPARATUS FOR SUPPORTING A PERSON'S HEAD ABOVE A MATTRESS OR OTHER SURFACE

BACKGROUND OF THE INVENTION

A. Field of the Invention

The field of the present invention relates generally to apparatuses that are configured to support a pillow above a surface, such as a mattress or the like. In particular, the present invention relates to such apparatuses that support a pillow above a surface in a manner which allows a person to more comfortably lay down or sleep on the surface. Even more particularly, the present invention relates to such pillow support apparatuses that are specifically configured to reduce pressure on the arms, shoulders and neck of the person sleeping on a pillow supported by the apparatus.

B. Background

Being able to sleep for a sufficient amount of time, preferably without interruption, is vitally important for a person's health and well-being. In fact, it is generally well known that getting sufficient good quality sleep can help protect and enhance a person's mental health, physical health, quality of life and safety. While a person sleeps, his or her body is working to support healthy brain function and maintain his or her physical health. Numerous studies have shown that a good night's sleep will improve a person's ability to learn and develop problem-solving skills. In addition, sleep also helps a person to pay attention, make decisions and be creative. It is also well known that a person who is sleep deficient is much more likely to have trouble making decisions, solving problems, controlling his or her emotions and behavior, and coping with change. Sleep deficiency has been linked to depression, suicide and risk-taking behavior. Sleep also plays a very important role in a person's physical health. For example, a good night's sleep helps heal and repair a person's heart and blood vessels. As such, sleep deficiency is well known to result in an increase in the risk of heart disease, kidney disease, high blood pressure, diabetes, stroke and the like. Sleep deficiency also increases the risk of obesity. In addition, because a person's immune system relies on sleep to stay healthy, a sleep deficient person is more likely to have difficulty in fighting common colds and infections.

There are many actions a person can take to improve the likelihood of obtaining a good night's sleep, including providing a comfortable sleeping surface and sleeping environment (i.e., bed and bedroom). A comfortable sleeping surface commonly includes a bed having a mattress and pillow, each of which are selected to be firm, soft and/or having other desirable characteristics, which will vary from person to person. A comfortable sleeping environment can be controlled by selectively controlling the temperature in the room and ensuring that the room is sufficiently quiet and dark. With regard to the comfortable sleeping surface, many bedding products, including products such as mattresses, blankets and pillows, have been specifically designed to increase a user's comfort while he or she is lying down in order to attempt to improve his or her sleep. Cooling and heating devices can control the temperature of the room, while noise machines and dark or blackout curtains can help control the sound and light in the room.

One of the most important issues with regard to being able to obtain a good night's sleep is the relationship of the person's head to the mattress or other sleeping surface on which he or she is sleeping. Generally, this issue is addressed through the proper selection of a pillow, which is utilized by a person to support his or head on the mattress. Most pillows are specifically designed to provide a select amount of support for the user's head and neck while he or she lays down on the mattress or other surface. Some pillows are configured to keep the user's spine in straight alignment while he or she sleeps on their side or back. These pillows may be provided with an upward curved portion that is designed to provide support in the area at the base of the skull for the user who sleeps on his or her back or at the neck and jawline for the user who sleeps on his or her side. Some pillows are manufactured out of specially selected materials that are chosen to provide support or flexibility and/or to contour to the user's unique shape.

As well known, many people prefer to sleep in a face-down position to increase comfort and alleviate issues with regard to breathing, loss of circulation, and pressure. For example, some people sleep face down because they are uncomfortable sleeping on their back due to breathing problems, such as a closing of their airway or sleep apnea. Some people sleep face down because they find that sleeping on their side causes their arms to fall asleep, their shoulders to hurt and/or their spine to feel misaligned. As generally well known, due to discomfort resulting from stress on their arms, hips, neck, head, shoulders and/or back, many people tend to toss and turn during the night trying to get comfortable or reposition their body to relieve the stress. Naturally, this tossing and turning is not conducive to being able to obtain a good night's sleep.

Unfortunately, sleeping facing down can cause problems with regard to proper blood circulation in the arms if the arms are pressed under the person's body. Because placing a person's face against a pillow can also cause breathing problems or issues with air flow or circulation, many users turn their head sideways when sleeping face-down to increase airflow and provide better temperature control. This can cause a strain on the user's neck, arms, and back, which is also likely to result in a poor night's sleep.

To address the problems with regard to a pillow not comfortably supporting their head while sleeping, some users will use their arms to bunch the pillow up under their head. Although this can provide some relief, the benefit is generally only temporary as the person's arms and shoulders will usually become sore from a lack of blood circulation or being bent at an uncomfortable angle (at least over time). Some people will utilize multiple pillows that are layered or at least partially layered in an attempt to provide comfortable support for their neck and head above the surface on which they sleep. Any such comfort from such efforts is also generally only temporary, as any movement by the person as he or she sleeps will usually undo the layering.

In addition to sleeping, many people enjoy reading, looking at a tablet or like electronic device, watching television or like non-sleeping bed activities with their body in a generally prone position while laying on a mattress or other surface. Though generally prone, most people are more comfortable doing these activities if their head is raised and supported at an angle above the surface. Although the desired angle can be achieved, at least to some extent, with the use of multiple pillows or like objects, many people do not have extra pillows or do not want to stack other objects on their bed just to be able to support their head at the inclined position. As such, most people tend to just fold over their pillow and do the best they can with regard to providing a comfortable inclined support for their non-sleeping activities.

Despite the prior art solutions to having comfortable head and neck support while sleeping or doing non-sleeping activities, what is needed is an improved apparatus that can be utilized to comfortably support a person's head and neck above a sleeping surface as he or she sleeps. The improved apparatus should be structured and arranged to support a person's head above a mattress or other sleeping support surface in a manner which allows the person to comfortably position his or her arms under their head without pain or other issues in his or her neck, back, arms, shoulders and other parts of the person's body. The apparatus should also be configured to comfortably support a person in a partially inclined position so he or she can read, view electronics or accomplish other activities while he or she is on the support surface. The new apparatus should be configured to be easy to use and not require any significant manipulation to move between a sleeping support position and an inclined support position. Preferably, the new apparatus is configured to be relatively inexpensive to manufacture.

SUMMARY OF THE INVENTION

The support apparatus of the present invention provides the benefits and solves the problems identified above. That is to say, the support apparatus of the present invention is structured and arranged to comfortably support a person's head in spaced apart relation above a mattress or other support surface while he or she sleeps. More specifically, the new support apparatus supports a person's head above the support surface in a manner which allows the user to place his or her arms under the support apparatus, and therefore his or her head, without causing pain to his or her arms, head, neck, back or other parts of his or her body. In a preferred configuration, the new support apparatus of the present invention has a pillow surface on which a pillow can be placed to comfortably support the user's head as he or she sleeps. The support apparatus of the present invention is also structured and arranged to comfortably support a person in a partially inclined position to allow him or her to read, view electronics, write or accomplish other activities while he or she is on the support surface. The new support apparatus is configured to be easy to use and does not require any significant manipulation to move the apparatus between its use for a sleeping support position and a partially inclined support position. In a preferred configuration, the new support apparatus is relatively inexpensive to manufacture.

In one embodiment of the present invention, the support apparatus generally comprises a first vertical support member, a second vertical support member, a first base member at the lower end of the first vertical support member, a second base member at the lower end of the second vertical support member, a transverse support member disposed between the first vertical support member and the second vertical support member, a height adjustment mechanism for adjusting the height of the transverse support member relative to the two vertical support members and a rear support member attached to or integral with the transverse support member. Each of the base members are sized and configured to be wider than the lower end of vertical support members so as to be able to more effectively distribute weight from the support apparatus to the support surface (i.e., the top of a mattress or the like) on which the support apparatus is utilized. The transverse support member has an upwardly disposed pillow support surface, a lower surface, a first end, a second end, a front edge and a rear edge. The transverse support member is disposed between the first vertical support member and the second vertical support member with the first end of the transverse support member attached to or integral with an inner sidewall of the first vertical support member and the second end of the transverse support member attached to or integral with an inner sidewall of the second vertical support member so as to dispose the first vertical support member in spaced apart relation to the second vertical support member. The transverse support member defines a support gap between its lower surface and the support surface when the support apparatus is placed on the support surface in a horizontal support position with the pillow support surface being disposed at least generally upward. The support gap is sized and configured to receive the user's arms while he or she sleeps. The transverse member further defines a platform height between the pillow support surface and the support surface that is selected so as to be comfortable for the user. The height adjustment mechanism is associated with each of the first vertical support member and the second vertical support member to removably secure the first vertical support member to the first end of the transverse support member and the second vertical support member to the second end of the transverse support member to allow the user to upwardly and downwardly adjust the platform height so as to increase or decrease the support gap and to position the pillow support surface to receive one or more cushioned objects, such as a pillow, thereon for supporting a person's head while he or she lays on the support surface. The rear support member is generally positioned at or near the rear edge of the transverse support member and is sized and configured to at least substantially prevent the cushioned object from sliding rearwardly off the pillow support surface during use of the support apparatus.

In a preferred configuration of the present invention, the support apparatus also has one or more stand-off members that are attached to or integral with the first vertical support member, the second vertical support member and/or the transverse support member. Each of the stand-off members are sized and configured to extend rearward of the rear edge of the transverse support member to define a stand-off distance between the rear edge of the transverse support member and a wall or headboard at or near the head end of the support surface. The preferred configuration of the new support apparatus also comprises an incline support mechanism for supportably moving the transverse support member so it will be angled relative to each of the first vertical support member and the second vertical support member to place the support apparatus in an inclined support position that will support the user's back as he or she engages in non-sleeping activities (i.e., reading, writing, viewing electronics, watching television and the like).

Accordingly, the primary object of the present invention is to provide a support apparatus to comfortably support a user's head that has the advantages set forth above and which overcomes the various disadvantages and limitations that are associated with presently available apparatuses for supporting a person's head while he or she is on a support surface.

It is an important object of the present invention to provide a new support apparatus that is structured and arranged to support a person's head while he or she is laying on a mattress or other support surface that comfortably supports the user's head without causing pain to his or her neck, shoulders, arms, back and other parts of his or her body.

It is an important object of the present invention to provide a new support apparatus that is structured and arranged to be utilized to comfortably support a person laying horizontally while sleeping on a bed or other support surface and when he or she is inclined while reading, writing, looking at electronics, watching television or doing other activities.

An important aspect of the present invention is that it provides a new support apparatus that accomplishes the objectives set forth above and elsewhere in the present disclosure.

Another important aspect of the present invention is that it provides a new support apparatus that is structured and arranged to comfortably support a person's head in spaced apart relation above a mattress or other support surface while he or she sleeps to allow the user to place his or her arms under the support apparatus, and therefore under his or her head, without causing pain to his or her arms, head, neck, back or other parts of his or her body.

Another important aspect of the present invention is that it provides a new support apparatus that has a pillow surface on which a pillow or like object can be placed to comfortably support the user's head as he or she sleeps, a support structure that supports the pillow surface above a mattress or other support surface and one or more rearwardly extending arms that keep the support apparatus in spaced apart relation to the wall or headboard at the end of a mattress.

Another important aspect of the present invention is that it provides a new support apparatus that is structured and arranged to support a person's head above a mattress or other support surface and to be adjusted to accommodate a wide variety of personal comfort settings.

Another important aspect of the present invention is that it provides a new support apparatus that is structured and arranged to support a person's head above a mattress or other support surface that can be easily adjusted to support the person as he or she lays in an inclined position on the support surface while reading, writing, viewing electronic devices, playing games or other activities.

Another important aspect of the present invention is that it provides a new support apparatus that is structured and arranged to support a person's head above a mattress or other support surface that can be made out of a wide variety of materials in a variety of different configurations.

Yet another important aspect of the present invention is that it provides a new support apparatus that is structured and arranged to support a person's head above a mattress or other support surface that is configured to be easy and relatively inexpensive to manufacture.

As will be explained in greater detail by reference to the attached figures and the description of the preferred embodiment which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the components of the new support apparatus of the present invention, as well as the pillow and support surface with which the new support apparatus may be utilized, those skilled in the art will readily appreciate that the present invention is not so limited. In addition, the exemplary embodiment of the present apparatus is shown and described herein with only the components that are necessarily required to disclose the present invention. Therefore, it is possible that some of the elements for attaching and using the present invention are not shown or necessarily described below, but which are well known to persons who are skilled in the relevant art. As will be readily appreciated by such persons, the various elements of the present invention that are described below may take on any form consistent with forms that are readily realized by a person of ordinary skill in the art having knowledge of support structures for use on a mattress or other support surface.

Figure 1:
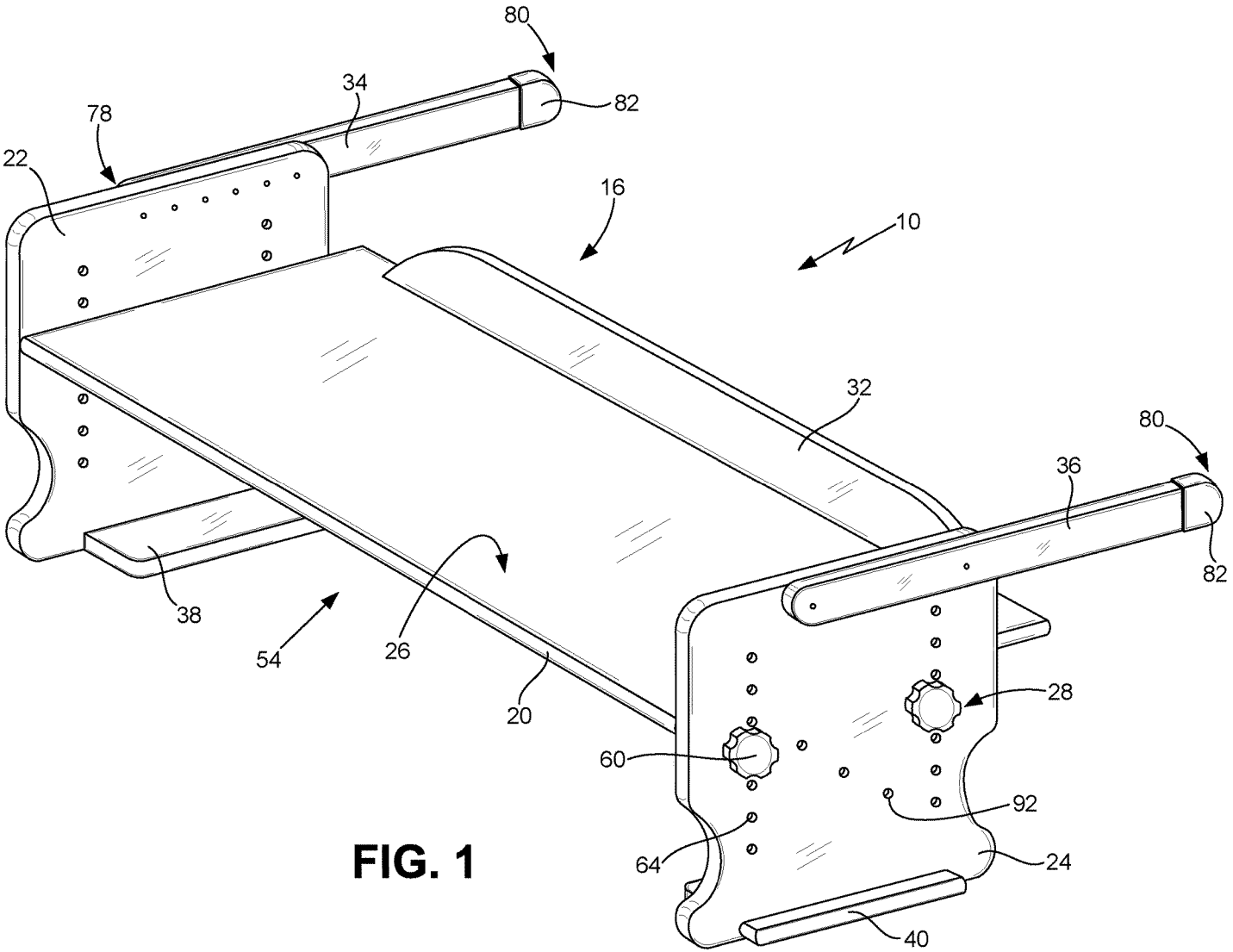
FIG. 1 is a right side perspective view of a support apparatus that is configured according to a first embodiment of the present invention, with the apparatus shown in its horizontal support position.
Figure 2:
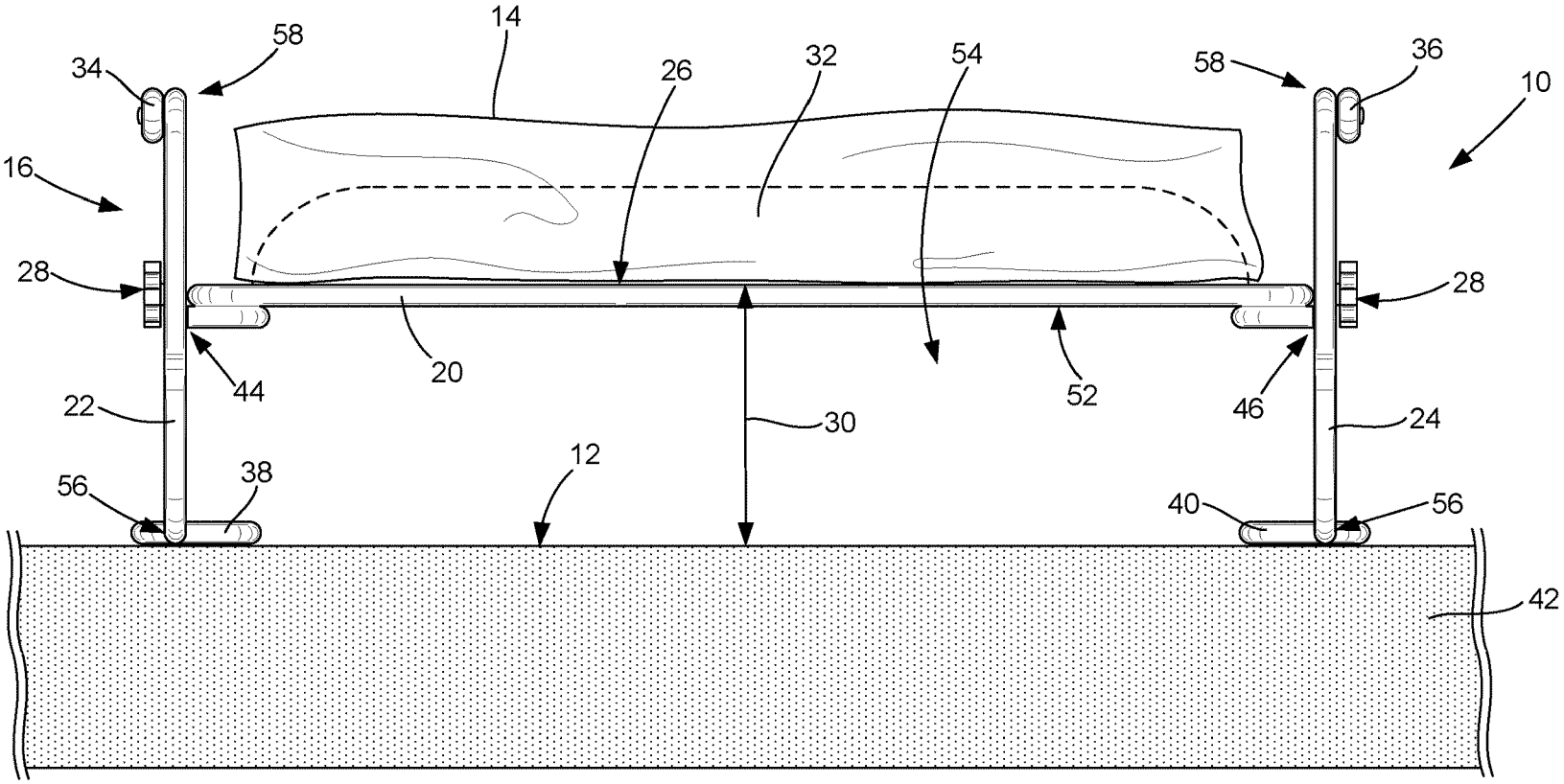
FIG. 2 is a front view of the support apparatus of FIG. 1, with the support apparatus shown on a mattress and with a pillow on the upwardly disposed surface of the transverse support member.
Figure 10:
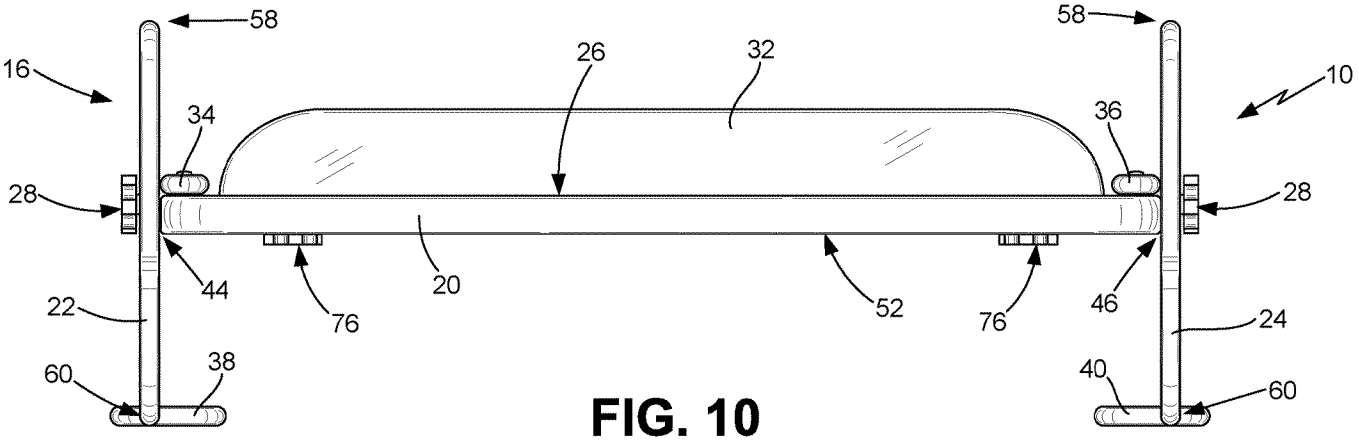
FIG. 10 is a front view of a support apparatus that is configured according to a second embodiment of the present invention, with the apparatus shown in its horizontal support position and having a removable rear support member.

A support apparatus that is configured pursuant to one or more of the preferred embodiments of the present invention is referred to generally as 10 in FIGS. 1-4 and 10. The new support apparatus 10 is structured and arranged to be utilized on a mattress or other support surface 12 to support one or more pillows or other cushion objects 14 in spaced apart relation above the support surface 12, as shown in FIG. 2. In the configuration of FIGS. 1-4, the support apparatus 10 is shown in its horizontal support position 16, such as how the new support apparatus 10 would be utilized by a person who is sleeping to support his or her head on the cushion object 14. In the configuration of FIG. 10, the support apparatus 10 is shown in its inclined support position 18, such as how the new support apparatus 10 would be utilized by a person who is using the support apparatus 10 to support himself or herself as he or she reads, writes, views a smart phone, tablet or other electronic device, watches television, plays a game or accomplishes other tasks.

As set forth in the Background, one of the most important issues with regard to being able to obtain a good night's sleep is the relationship of the person's head to the mattress or other sleeping support surface 12 on which he or she is sleeping. While the selection of a good pillow or other head cushion object 14 is important, a standard pillow 14 does not resolve many of the comfort issues, particularly with regard to persons who like to sleep with one or more arms under their head. In such sleeping positions pressure on the arms can cause their arms to fall asleep, their shoulders to hurt and/or their spine to feel misaligned, resulting in discomfort to the person's arms, hips, neck, head, shoulders and/or back. This discomfort is not conducive to being able to obtain a good night's sleep. Use of the support apparatus 10 of the present invention in its horizontal support position 16 while sleeping will solve the aforementioned problems. In addition, in its inclined position 18, the new support apparatus 10 will be useful for the user to support himself or herself partially upright so he or she can more comfortably read, write, view a smart phone, tablet or other electronic device, watch television, play a game or perform other non-sleeping activities.

In one embodiment of the new support apparatus 10 of the present invention generally comprises a transverse support member 20, a left or first vertical support member 22 and a right or second vertical support member 24, as best shown in FIGS. 1-3 and 10. The transverse support member 20 has a pillow support surface 26, the transverse support member 20 interconnects the spaced apart vertical support members 22/24 and the two vertical support members 22/24 support the transverse support member 20 in spaced apart relation to the mattress or other support surface 12. As shown in FIGS. 1-3 and 10, when the apparatus 10 is in its horizontal support position 18, the pillow support surface 26 is substantially upwardly disposed so as to support the pillow or other cushioned object 16 thereon for use while sleeping, as shown in FIG. 2. As explained in more detail below, in the preferred configuration, the transverse support member 20 and vertical support members 22/24 are cooperatively configured with a height adjustment mechanism 28 that allows the user to adjust distance between the support surface 12 and the pillow support surface 26, which is identified as the platform height 30 in FIGS. 2, 3 and 10, on which the pillow or other cushioned object 14 is placed. In one of the preferred embodiments, the new support apparatus 10 also comprises a rear support member 32 attached to the transverse support member 20, a left or first stand-off member 34, a right or second side space member 36, a left or first base member 38 and a right or second base member 40, as shown in FIGS. 1-4 and 10. The configuration, use and benefits of the above-identified components of the new support apparatus 10 are set forth in more detail below.

For purposes of disclosing and describing the present invention, the terms "front", "forward", "forwardly" and the like and the terms "rear", "rearward" and "rearwardly" are utilized to reference locations of the support apparatus 10 of the present invention with regard to the position of the user when he or she is using the support apparatus 10 for sleeping or non-sleeping activities. The user will be laying, generally flat or at an incline, on the support surface 12, which in the FIG. 2 is a mattress 42, with his or head on the pillow or other cushioned object 14 such that the top of his or her head is near the rear support member 32 with his or her body extending away from rear support member 32 and the transverse support member 20. As best shown in FIGS. 1 and 4, a portion of each of the two stand-off members 34/36 extend rearward of the rear support member 32, typically to contact the wall or the headboard at one end of the mattress 42. The terms "left" and "right" refer to the relative positions of the components when viewed from the front of the support apparatus 10, as shown in FIGS. 2, 3 and 10.

As set forth above, the transverse support member 20 is utilized to provide the pillow support surface 26 on which the pillow or other cushioned support 14 will be positioned, if not attached thereto, when the user is utilizing the support apparatus 10 for sleeping or various non-sleeping activities. As also set forth above, the transverse support member 20 interconnects the first vertical support member 22 and the second vertical support member 24. The transverse support member 20 has a left or first end 44 and a right or second end 46 that are associated with, respectively, the first vertical support member 22 and the second vertical support member 24, as best shown in FIGS. 2 and 3. In the embodiment shown in the figures, the first end 44 of the transverse support member 20 is joined to the inner sidewall 48 of the first vertical support member 22 by the height adjustment mechanism 28 and the second end 46 of the transverse support member 20 is joined to the inner sidewall 50 of the second vertical support member 24, as best shown in FIG. 3. As set forth in more detail below, the transverse support member 20, first vertical support member 22, second vertical support member 24 and the height adjustment mechanism 28 are cooperatively configured to allow the user to adjust the platform height 30 of the pillow support surface 26 above the support surface 12. The transverse support member 20 has a lower surface 52. In a preferred configuration of the support apparatus 10, the pillow support surface 26 and the lower surface 52 (shown in FIGS. 2-3) of the transverse support member 20 are generally planar and smooth, so as to not interfere with the placement or use of the pillow or other cushioned object 14 on the pillow support surface 26 and/or harm the user's arms, which will be in the support gap 54 (shown in FIGS. 1-3) between the lower surface 52 of the transverse support member 20 and the support surface 12, particularly as he or she moves their arms around during the night as he or she sleeps.

Figure 3:
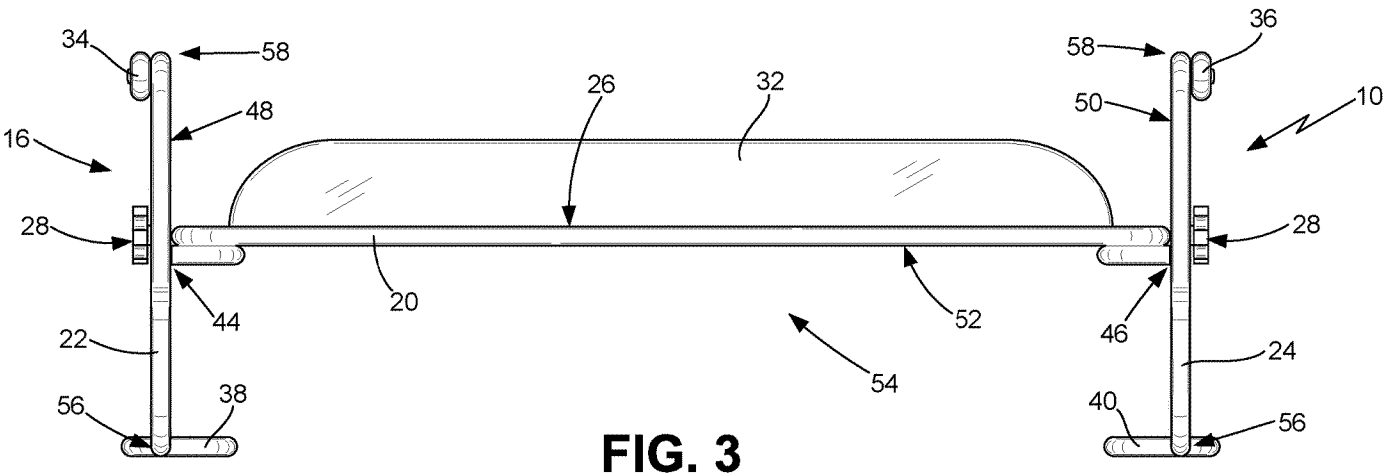
FIG. 3 is a front view of the support apparatus of FIG. 1.
Figure 4:
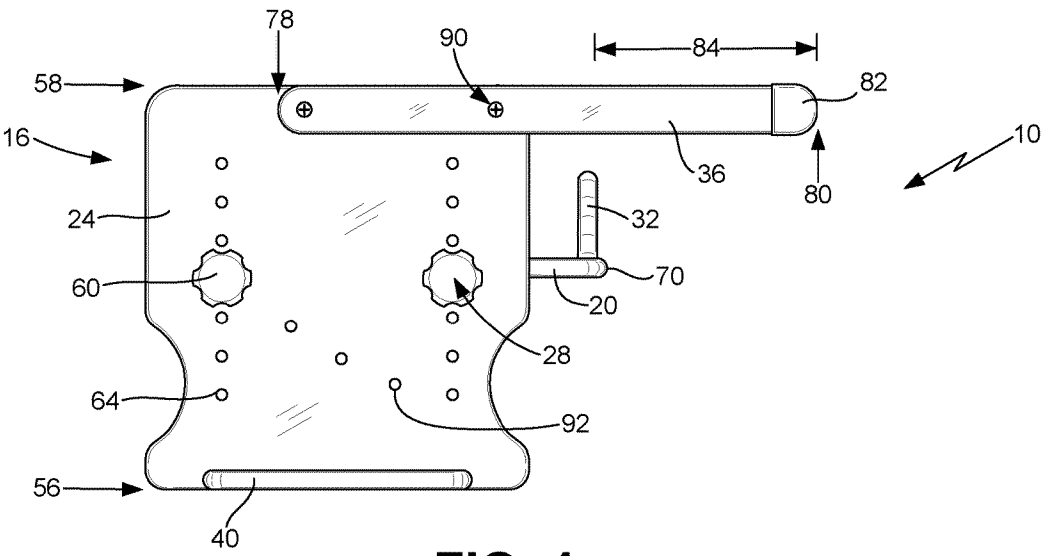
FIG. 4 is a right side view of the support apparatus of FIG. 1.

The vertical support members 22/24 are utilized to support the transverse support member 20 above the support surface 12 so as to define the platform height 30 at which the pillow or other cushioned object 14 will be placed on the pillow support surface 26, as best shown in FIGS. 2-3 and 10. Each of the vertical support members 22/24 have a lower end 56 that is placed at or near the support surface 12 and an upper end 58 that extends upwardly therefrom, as best shown in FIG. 2. In the embodiments shown in the figures, the base members 38/40 are attached to or integral with the lower end 56 of the respective vertical support members 22/24 and the stand-off members 34/36 are attached to or integral with the upper end 58 of the respective vertical support members 22/24, as shown in FIGS. 1-4 and 10. Although it will be generally necessary for the base members 38/40 to be at or integral with the lower end of the vertical support members 22/24, it is not required that the stand-off members 34/36 be at or near the upper end 58 of the vertical support members 22/24. As will be readily appreciated by persons skilled in the art, the stand-off members 34/36 can be positioned elsewhere on the vertical support members 22/24 or, if desired, they can be attached to or integral with the transverse support member 20, such as at the upwardly disposed pillow support surface 26 (as shown in FIG. 10), the lower surface 52 or extending rearward from the rear edge of the transverse support member 20.

The base members 38/40, which are attached to or integral with the lower end 56 of the vertical support members 22/24, are sized and configured to be placed on and in abutting relation to the support surface 12 so as to support the support apparatus 10 on the support surface 12. As best shown in FIGS. 1-3, the base members 38/40 are generally wide flat members that are configured to distribute the weight of the support apparatus 10 and the portions of the person laying or leaning against the support apparatus 10 over a wider area to reduce the likelihood of the support apparatus 10 damaging (i.e., by "digging" into) the support surface 12, particularly when it is the upper surface of a mattress 42, as shown in FIG. 2. In addition, the base members 38/40 are sized and configured to stabilize the support apparatus 10 as it, and any weight that is applied to it (such as on the pillow support surface 26), rests on the support surface 12. In one embodiment of the new support apparatus 10, the base members 38/40 are approximately three to five inches wide and six to ten inches long (with the length being related to the front to back length of the vertical support members 22/24). However, as will be readily appreciated by persons skilled in the relevant art, the size of the base members 38/40 can be selected as may be necessary or beneficial to provide the benefits described above based on weight and other factors.

Figure 9:
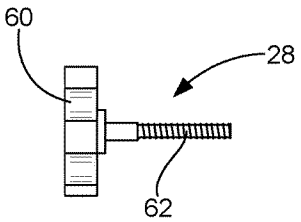
FIG. 9 is a side view of a knob having a threaded stem as the height adjusting mechanism.

The height adjustment mechanism 28 is utilized to vary the platform height 30 so the user can selectively adjust the height above the support surface 12 that he or she wants to position the transverse support member 20 and, therefore, the pillow support surface 26 on which the pillow or other cushioned object 14 will be placed. The height of the pillow support surface 26 will depend on the user's size and other factors regarding the placement of his or her head on the cushioned object 14 and the placement of his or her arms in the support gap 54 under the transverse support member 20. In the embodiment shown in the figures, the height adjustment mechanism 28 comprises a knob 60 having an elongated, threaded stem 62 attached thereto or integrally formed therewith, as shown in FIG. 9. In this embodiment, the stem 62 is sized and configured to extend through the height adjustment apertures 64 in the vertical support members 22/24 and into the transverse apertures 66 at the ends 44/46 of the transverse support member 20 between the front edge 68 and rear edge 70 thereof, as best shown in FIGS. 1 and 4-6. Although not shown, the transverse apertures 66 can be internally threaded or have an internally threaded device that is cooperatively sized and configured with the stem 62 so as to be threadably engaged by the stem 62. In use, the user will rotate the knob 60, which rotates the fixed stem 62, to loosen or tighten the connection of the height adjustment mechanism 28. To change the platform height 30 for a different height of the pillow support surface 26, the user loosens the height adjustment mechanism 28 to separate the vertical support members 22/24 from the transverse support member 20, repositions the transverse support member 20 using other height adjustment apertures 64 and then re-joins the vertical support members 22/24 to the transverse support member 20. In the embodiment shown with the knob 60 and stem 62, the stem 62 is removed from the transverse apertures 64 when adjusting the platform height 30.

As will be readily appreciated by those skilled in the art, a variety of other types of adjusting mechanisms 28, as opposed to the knob 60, stem 62 and apertures 64 shown in the figures, can be utilized with the support apparatus 10 of the present invention. For instance, the height adjusting mechanism 28 can comprise a slot, instead of the apertures 64, through which the stem 62 is inserted to engage a cooperatively threaded transverse aperture 66 or device inside the transverse aperture 66 on the opposite side of the slot. As with using the height adjustment apertures, the transverse support member 20 would move upward and downward along the slot in the inner sidewalls 48/50 of vertical support members 22/24. If desired, the height adjusting mechanism 28 can utilize a gear or other type of ratcheting device interconnecting the transverse support member 20 and the vertical support members 22/24 to allow the user to easily move the transverse support member 20 up and down. Any height adjusting mechanism 28 utilized with the support apparatus 10 of the present invention should be configured to allow the user to easily move the transverse support member 20 relative to the vertical support members 22/24 to adjust the platform height 30 so the pillow support surface 26 will be at the desired height while the user sleeps. In addition, the height adjusting mechanism 28 should be configured to be as unobtrusive as possible so as to not interfere with the user while he or she sleeps.

The rear support member 32 is utilized to prevent the pillow or other cushioned object 14 from sliding rearward off of the pillow support surface 26. As set forth above and explained in more detail below, the stand-off members 34/36 are utilized as stand-offs that maintain a space between the rear edge 70 of the transverse support member 20 and the wall or headboard at the "head end" of the mattress 42 (as providing the typical support surface 12). The rear support member 32 prevents the pillow or other cushioned object 14 from sliding rearward off of the pillow support surface of the transverse support member 20 while the user is sleeping. The rear support member 32 has a lower end 72 that is at the transverse support member and an upper end 74 that extends above the pillow support surface 26 a sufficient amount to impede rearward sliding of the pillow or other cushioned object 14. In one embodiment, the lower end 72 of the rear support member 32 is fixedly attached to the transverse support member 20 and the upper end 74 of the rear support member 32 extends approximately two to three inches above the pillow support surface 26. In another embodiment, such as the embodiment shown in FIG. 10, the rear support member 32 can be removably attached to the transverse support member 20, such as using a rear connecting mechanism 76 similar to the knob/stem height adjusting mechanism 28 described above. Alternatively, as will be readily appreciated by persons skilled in the art, a wide variety of devices can be utilized for the rear connecting mechanism 76.

Figure 7:
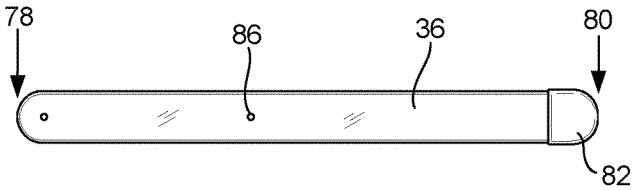
FIG. 7 is a right side view of the second stand-off member of the support apparatus of FIG. 1.
Figure 5:
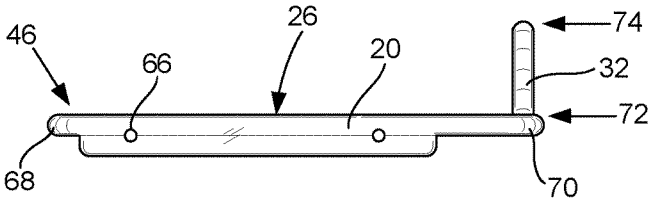
FIG. 5 is a right side view of the transverse support member of the support apparatus of FIG. 1.
Figure 6:
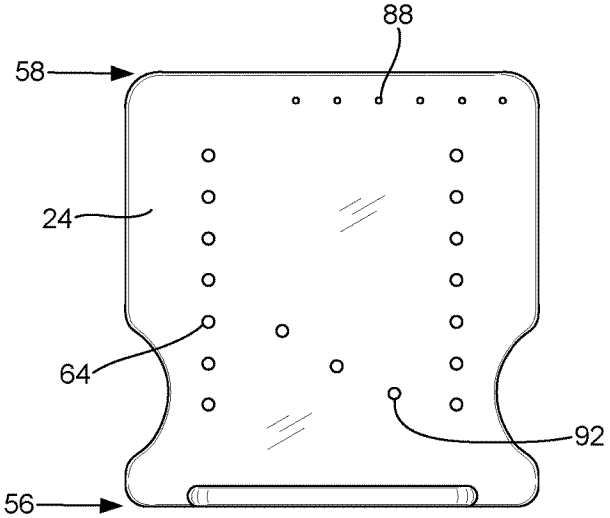
FIG. 6 is a right side view of the second vertical support member of the support apparatus of FIG. 1.

The stand-off members 34/36, also referred to as stand-offs, are utilized to maintain a desired spacing between the rear edge 70 of the transverse support member 20 and the wall or headboard at the "head end" of the mattress 42 or other object defining the support surface 12. One purpose for using the stand-off members 34/36 is to provide the user with more room to stretch out and move around his or her arms while using the support apparatus 10 for sleeping. As will be readily appreciated by persons skilled in the art, if the rear edge 70 of the transverse support member 20 were at or very near the wall or headboard, the user could feel boxed in with regard to movement of his or her arms, which would not be conducive to good sleep for most users. In the embodiment shown in the figures, the stand-off members 34/36 each have a first or inward end 78 attached to or integral with the vertical support members 22/24 and a second or outward end 80 in spaced apart relation to the rear edge 70 of the transverse support member 20, as best shown in FIGS. 1, 4 and 7-8. Because the outward end 80 of the stand-off members 34/36 will be in contact with the wall or headboard, it may be desirable to have a protective tip 82 over or at the outward end 80, as shown in FIGS. 1, 4 and 7-8. In one embodiment, the stand-off members 34/36 can be fixedly attached to or integral with the vertical support members 22/24. In a preferred configuration, however, the stand-off distance 84 between the rear edge 70 of the transverse support member 20 provided by the stand-off members 34/36, as best shown in FIG. 4, is adjustable in length to allow the user to adjust the stand-off distance 84 for his or her preference. In the embodiment shown in the figures, the adjustment capability is achieved by providing spacer apertures 86 in the stand-off members 34/36 that correspond to length adjusting apertures 88 in the vertical support members 22/24, as best shown in FIGS. 6 and 7, that are sized and configured to cooperatively receive a spacer connecting mechanism 90, which (as shown in FIG. 4) may be a screw, bolt or the like.

Figure 11:
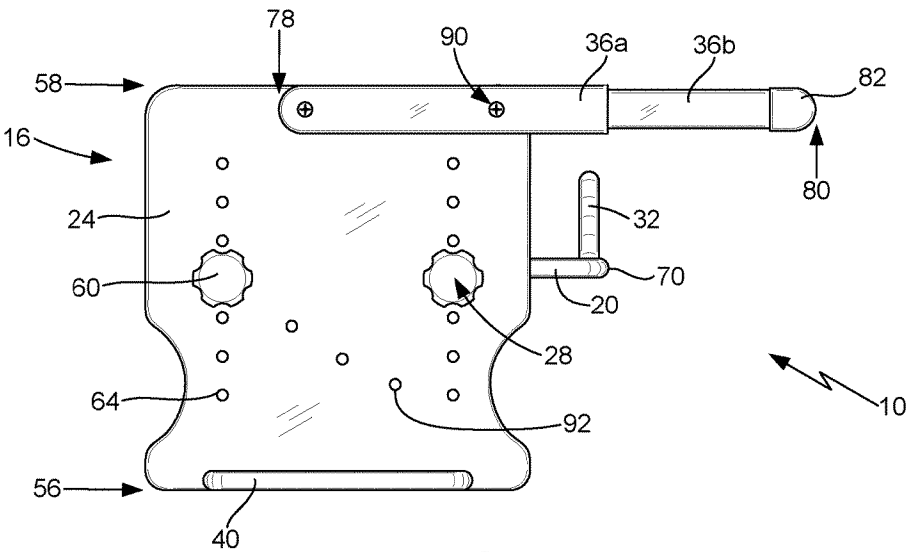
FIG. 11 is a right side view of a support apparatus that utilizes telescopically configured stand-off members.

As will be readily appreciated by persons skilled in the art, a wide variety of alternative configurations are available for the placement of the stand-off members 34/36 and the spacer connecting mechanism 90 that is utilized to adjust the amount of stand-off distance 84. For instance, the stand-off members 34/36 can be attached to the inner sidewalls 48/50 of the vertical support members 34/36 or one or more of the stand-off members 34/36 can be attached to the pillow support surface 26 and/or the lower surface 52 of the transverse support member 20, as shown in FIG. 10. The spacer connecting mechanism 90 that is utilized to connect the one or more stand-off members 34/36 to at least one of the vertical support members 22/24 and the transverse support member 20 can be configured with a knob 60 and stem 62 type components of the height adjustment mechanism 28. Alternatively, the spacer connecting mechanism 90 can comprise slide devices (such as used for drawers and the like), gear mechanisms and the like which can be locked in place to set the stand-off distance. In yet another embodiment, the stand-off members 34/36 can be telescopically configured, such as shown in FIG. 11 (having stand-off member components 36*a* and 36*b*), with stand-off members 34/36 either fixedly attached to, integral with or moveably attached to one or more of the vertical support members 22/24 or the transverse support member 20 to allow the user to adjust the stand-off distance 84 to his or her preference.

Figure 8:
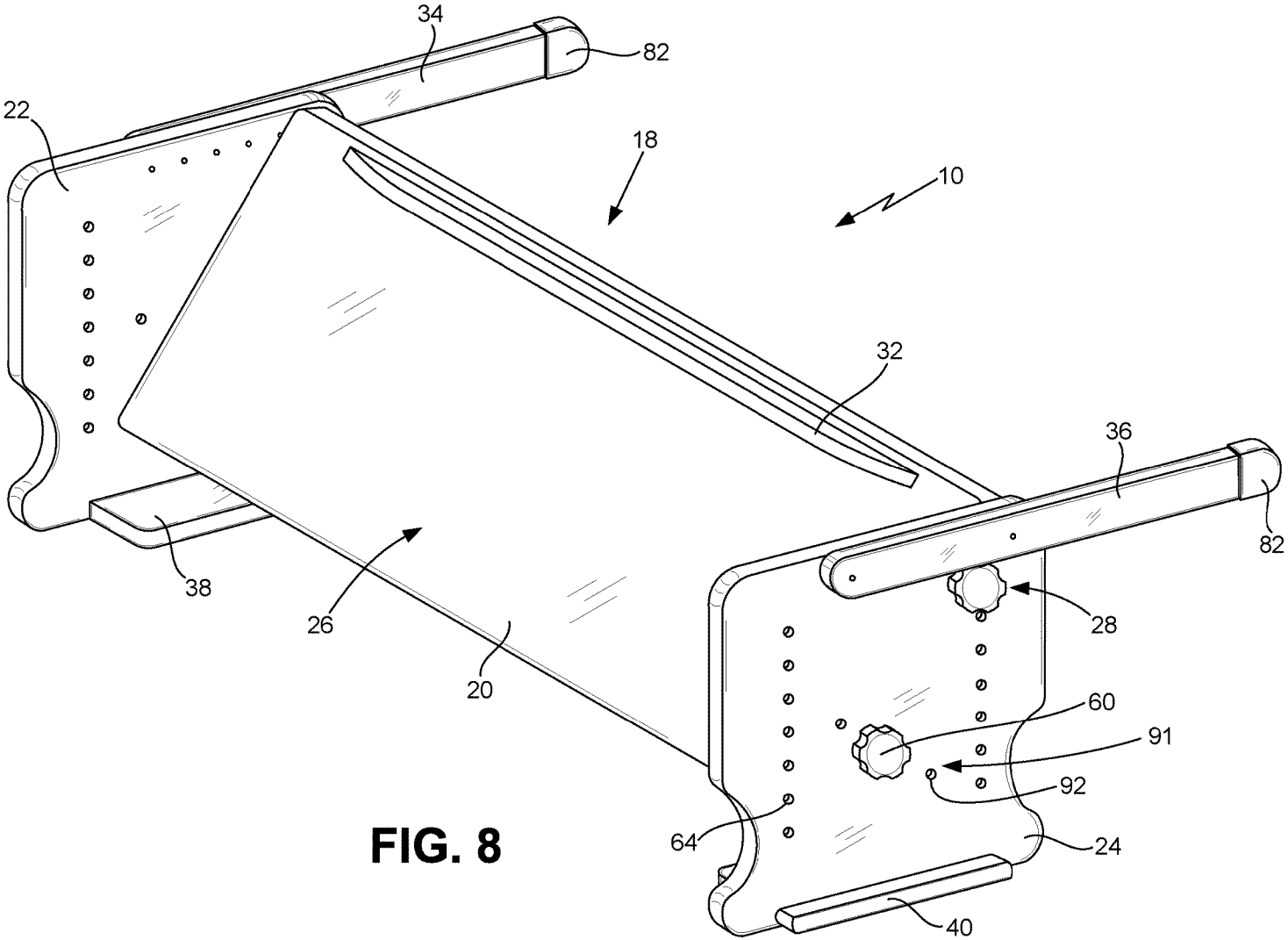
FIG. 8 is a right side perspective view of the support apparatus of FIG. 1 shown in its inclined support position.

As set forth above, in a preferred configuration of the new support apparatus 10 of the present invention, the support apparatus 10 has an incline support mechanism 91 that allows the support apparatus 10 to be moved between the horizontal support position 16, as best shown in FIGS. 1-4, and the inclined support position 18, as shown in FIG. 8. In the embodiment shown in the figures, the incline support mechanism 91 comprises each of the vertical support members 34/36 having incline apertures 92 that are positioned on the vertical support members 34/36 so as to allow the transverse support member 20 to be pivotally supported in either a substantially horizontal angle for the horizontal support position 16 and an inclined angle for the inclined support position 18. In the preferred configuration, the user can utilize components from the height adjustment mechanism 28 to place the support apparatus 10 in its inclined support position 18. As shown in FIG. 8, the same knob 60 and stem 62 device is utilized to engage, by being received through, the incline apertures 92 and to connect to the transverse apertures 66 in the ends 44/46 of the transverse support member 20.

The support apparatus 10 of the present invention can be made out of a wide variety of different materials, including wood, plastic, metal, composites and the like. Preferably, the completed apparatus 10 will be relatively light weight so as to be easy to move and not unduly interfere with the support surface 12. The various components of the support apparatus 10 should be selected such that when all of these components are combined they will provide sufficient structural integrity to comfortably support the user's head in the horizontal support position 16 and the user's back (as he or she leans against the support apparatus 10) in the inclined support position 18. In addition, the various components need to be manufactured in a manner which keeps the comfort and safety of the user in the forefront. For instance, the front edge 68 and rear edge 70 of the transverse support member 20 should be curved or rounded to provide a smooth surface against which the user will contact when he or she is sleeping. Likewise, all of the edges of the various components, including the vertical support members 22/24, the base members 38/40 and the stand-off members 34/36 should have smooth and/or rounded edges. The support apparatus 10 should be sized and configured to be easy to move and easily fit on the desired support surface 12, such as the front area of a mattress 42. In one embodiment, the transverse support member 20 is approximately ten to fourteen inches between the front edge 68 and the rear edge 70 and approximately twenty-four to twenty-eight inches between the first end 44 and second end 46, the vertical support members 22/24 are approximately eight to twelve inches high (lower end 56 to upper end 58) and eight to twelve inches deep (front to back) and the stand-offs 34/36 are approximately twelve to sixteen inches long (inward end 78 to outward end 80) to provide a stand-off distance 84 of approximately six to ten inches. The above dimensions are provided for exemplary purposes only. As will be readily appreciated by persons skilled in the art, the actual dimensions of the support apparatus 10 can vary significantly depending on the preferences of the user and the intended use of the support apparatus 10. For instance, a cushioned object 14 could be fixedly attached to the pillow support surface 26 of the transverse support member 20. Likewise, the support surface 12 can be any type of surface, including a floor, couch or the like, on which the user may want to be in a generally prone and/or inclined position.

In use, the components of the support apparatus 10 are combined to place the support apparatus 10 in its horizontal support position 16 for sleeping use. The user will utilize the height adjustment mechanism 28 to adjust the position of the transverse support member 20 relative to the vertical support members 22/24 to place the pillow support surface 26 at the desired height above the support surface 12 when the support apparatus 10 is placed thereon. The user will also adjust the position of the stand-off members 34/36 to provide the desired stand-off distance 84. The support apparatus 10 is then placed on the support surface 12 with the outward end 80 of the stand-off members 34/36 against the wall or headboard (preferably with the protective tips 82 in place)

and the base members 38/40 against the support surface 12. The pillow or other cushioned object 14 is then placed on the pillow support surface 26. The user will lay his or her head against the cushioned object 14 with his or her arms in the support gap 54 under the lower surface 52 of the transverse support member 20. If the user desires to read, write, view electronic devices, watch television or engage in other non-sleeping activities, he or she merely has to adjust the angle of the transverse support member 20 to place the support apparatus 10 in its inclined position 18, place one or more pillows or other cushioned objects 14 against the transverse support member 20 and then comfortably lean against the cushioned objects 14 to perform the non-sleeping activity. When the user is ready to go to sleep, he or she merely has to reverse the above process and place the support apparatus 10 back into its horizontal support position 16 with the cushioned objects 14 on the pillow support surface 26 of the transverse support member 20.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A support apparatus for use on a support surface, said support apparatus comprising:

a first vertical support member having a lower end, an upper end and an inner sidewall;

a second vertical support member having a lower end, an upper end and an inner sidewall;

a transverse support member having a pillow support surface, a lower surface, a first end, a second end, a front edge and a rear edge, said transverse support member disposed between said first vertical support member and said second vertical support member with said first end of said transverse support member attached to or integral with said inner sidewall of said first vertical support member and said second end of said transverse support member attached to or integral with said inner sidewall of said second vertical support member so as to dispose said first vertical support member in spaced apart relation to said second vertical support member, said transverse support member defining a support gap between said lower surface thereof and the support surface when said support apparatus is placed on said support surface in a horizontal support position with said pillow support surface being disposed at least generally upward, said transverse member further defining a platform height between said pillow support surface and the support surface; and one or more stand-off members attached to or integral with at least one of said first vertical support member, said second vertical support member and said transverse support member, each of said one or more stand-off members sized and configured to extend rearward of said rear edge of said transverse support member so as to define a stand-off distance, wherein said platform height is selected so as to position said pillow support surface to receive a cushioned object thereon for supporting a person's head on the cushioned object while he or she lays on the support surface.

2. The support apparatus of claim 1, wherein each of said first vertical support member and said second vertical support member are attached to said transverse support member, said support apparatus further comprising a height adjustment means at each of said first vertical support member and said second vertical support member for removably securing said first vertical support member to said first end of said transverse support member and said second vertical support member to said second end of said transverse support member for upwardly and downwardly adjusting the platform height so as to position said pillow support surface to receive one or more cushioned objects thereon.

3. The support apparatus of claim 2, wherein said height adjustment means comprises a plurality of height adjustment apertures in each of said first vertical support member and said second vertical support member, one or more transverse apertures in each of said first end and said second end of said transverse support member and a knob having a threaded stem, said stem sized and configured to pass through said height adjustment apertures and into said transverse apertures to place said support apparatus in said horizontal support position.

4. The support apparatus of claim 1 further comprising a first base member at said lower end of said first vertical member and a second base member at said lower end of said second vertical member, each of said first base member and said second base member being sized and configured to be wider than said lower end of each of said first vertical support member and said second vertical support member so as to more effectively distribute weight from said support apparatus to the support surface.

5. The support apparatus of claim 1 further comprising a rear support member attached to or integral with said transverse support member generally at or near said rear edge thereof, said rear support member sized and configured to at least substantially prevent the cushioned object from sliding rearwardly off said pillow support surface.

6. The support apparatus of claim 5, wherein said rear support member is removably attached to said transverse support member.

7. The support apparatus of claim 1, wherein each of said one or more stand-off members are moveably attached to said at least one of said first vertical support member, said second vertical support member and said transverse support member so as to increase or decrease said stand-off distance.

8. The support apparatus of claim 7, wherein each of said first vertical support member and said second vertical support member have at least one of said one or more stand-off members moveably attached thereto.

9. The support apparatus of claim 7, wherein said transverse support member apparatus has at least one of said one or more stand-off members moveably attached thereto.

10. The support apparatus of claim 1, wherein each of said one or more stand-off members are telescopically configured.

11. The support apparatus of claim 1 further comprising an incline support means for supportably moving said transverse support member to be angled relative to each of said first vertical support member and said second vertical support member so as to place said support apparatus in an inclined support position.

12. The support apparatus of claim 11, wherein said incline support means comprises a plurality of incline apertures in each of said first vertical support member and said second vertical support member, each of said incline apertures positioned so as to be in corresponding relation with one or more transverse apertures on said transverse support member.

13. A support apparatus for use on a support surface, said support apparatus comprising:

a first vertical support member having a lower end, an upper end and an inner sidewall;

a second vertical support member having a lower end, an upper end and an inner sidewall;

a first base member at said lower end of said first vertical support member;

a second base member at said lower end of said second vertical support member, each of said first base member and said second base member being sized and configured to be wider than said lower end of each of said first vertical support member and said second vertical support member so as to more effectively distribute weight from said support apparatus to the support surface;

a transverse support member having a pillow support surface, a lower surface, a first end, a second end, a front edge and a rear edge, said transverse support member disposed between said first vertical support member and said second vertical support member with said first end of said transverse support member attached to or integral with said inner sidewall of said first vertical support member and said second end of said transverse support member attached to or integral with said inner sidewall of said second vertical support member so as to dispose said first vertical support member in spaced apart relation to said second vertical support member, said transverse support member defining a support gap between said lower surface thereof and the support surface when said support apparatus is placed on said support surface in a horizontal support position with said pillow support surface being disposed at least generally upward, said transverse member further defining a platform height between said pillow support surface and the support surface;

one or more stand-off members attached to or integral with at least one of said first vertical support member, said second vertical support member and said transverse support member, each of said one or more stand-off members sized and configured to extend rearward of said rear edge of said transverse support member so as to define a stand-off distance; and a height adjustment means at each of said first vertical support member and said second vertical support member for removably securing said first vertical support member to said first end of said transverse support member and said second vertical support member to said second end of said transverse support member for upwardly and downwardly adjusting the platform height so as to increase or decrease said support gap and to position said pillow support surface to receive one or more cushioned objects thereon for supporting a person's head while he or she lays on the support surface.

14. The support apparatus of claim 13, wherein said height adjustment means comprises a plurality of height adjustment apertures in each of said first vertical support member and said second vertical support member, one or more transverse apertures in each of said first end and said second end of said transverse support member and a knob having a threaded stem, said stem sized and configured to pass through said height adjustment apertures and into said transverse apertures to place said support apparatus in said horizontal support position.

15. The support apparatus of claim 13 further comprising a rear support member attached to or integral with said transverse support member generally at or near said rear edge thereof, said rear support member sized and configured to at least substantially prevent the cushioned object from sliding rearwardly off said pillow support surface.

16. The support apparatus of claim 13, wherein each of said one or more stand-off members are moveably attached to said at least one of said first vertical support member, said second vertical support member and said transverse support member so as to increase or decrease said stand-off distance.

17. The support apparatus of claim 13 further comprising an incline support means for supportably moving said transverse support member to be angled relative to each of said first vertical support member and said second vertical support member so as to place said support apparatus in an inclined support position.

18. The support apparatus of claim 17, wherein said incline support means comprises a plurality of incline apertures in each of said first vertical support member and said second vertical support member, each of said incline apertures positioned so as to be in corresponding relation with one or more transverse apertures on said transverse support member.

19. A support apparatus for use on a support surface, said support apparatus comprising:

a first vertical support member having a lower end, an upper end and an inner sidewall;

a second vertical support member having a lower end, an upper end and an inner sidewall;

a first base member at said lower end of said first vertical support member;

a second base member at said lower end of said second vertical support member, each of said first base member and said second base member being sized and configured to be wider than said lower end of each of said first vertical support member and said second vertical support member so as to more effectively distribute weight from said support apparatus to the support surface;

a transverse support member having a pillow support surface, a lower surface, a first end, a second end, a front edge and a rear edge, said transverse support member disposed between said first vertical support member and said second vertical support member with said first end of said transverse support member attached to or integral with said inner sidewall of said first vertical support member and said second end of said transverse support member attached to or integral with said inner sidewall of said second vertical support member so as to dispose said first vertical support member in spaced apart relation to said second vertical support member, said transverse support member defining a support gap between said lower surface thereof and the support surface when said support apparatus is placed on said support surface in a horizontal support position with said pillow support surface being disposed at least generally upward, said transverse member further defining a platform height between said pillow support surface and the support surface;

a height adjustment means at each of said first vertical support member and said second vertical support member for removably securing said first vertical support member to said first end of said transverse support member and said second vertical support member to said second end of said transverse support member for upwardly and downwardly adjusting the platform height so as to increase or decrease said support gap and to position said pillow support surface to receive one or more cushioned objects thereon for supporting a person's head while he or she lays on the support surface;

a rear support member attached to or integral with said transverse support member generally at or near said rear edge thereof, said rear support member sized and configured to at least substantially prevent the cushioned object from sliding rearwardly off said pillow support surface;

one or more stand-off members attached to or integral with at least one of said first vertical support member, said second vertical support member and said transverse support member, each of said one or more stand-off members sized and configured to extend rearward of said rear edge of said transverse support member so as to define a stand-off distance; and an incline support means for supportably moving said transverse support member to be angled relative to each of said first vertical support member and said second vertical support member so as to place said support apparatus in an inclined support position.

20. The support apparatus of claim 19, wherein said incline support means comprises a plurality of incline apertures in each of said first vertical support member and said second vertical support member, each of said incline apertures positioned so as to be in corresponding relation with one or more transverse apertures on said transverse support member.

* * * * *